United States Patent [19]

Brill

[11] 4,123,055

[45] Oct. 31, 1978

[54] GOLF CLUBS

[76] Inventor: Harry M. Brill, 5818 N. Kostner, Chicago, Ill. 60629

[21] Appl. No.: 755,992

[22] Filed: Jan. 3, 1977

[51] Int. Cl.[2] ..... A63B 53/00; A63B 53/12

[52] U.S. Cl. ..... 273/77 A; 273/80 B

[58] Field of Search ..... 273/77 R, 77 A, 80 R, 273/80 A, 80 B, 80.9, 81 R, 81 A, 80.1

[56] References Cited

U.S. PATENT DOCUMENTS

| | | | |
|---|---|---|---|
| 1,680,447 | 8/1928 | Bryant | 273/80 R |
| 2,037,636 | 4/1936 | Lagerblade | 273/80 B |
| 2,153,880 | 4/1939 | Barnhart | 273/80 B X |
| 2,250,428 | 7/1941 | Vickery | 273/80 B |
| 2,250,429 | 7/1941 | Vickery | 273/80 B |
| 2,250,441 | 7/1941 | Vickery | 273/80 B |
| 3,685,135 | 8/1972 | Letters | 273/80 B X |
| 3,871,649 | 3/1975 | Kilshaw | 273/80 B X |

FOREIGN PATENT DOCUMENTS

| | | | |
|---|---|---|---|
| 2,310,400 | 9/1974 | Fed. Rep. of Germany | 273/77 A |
| 3,288 of | 1913 | United Kingdom | 273/80 B |
| 470,178 | 8/1937 | United Kingdom | 273/80B |
| 483,995 | 4/1938 | United Kingdom | 273/80 B |

*Primary Examiner*—Richard J. Apley

*Attorney, Agent, or Firm*—Brezina & Lund

[57] ABSTRACT

A set of matched golf clubs is provided, each including a shaft having a step at the junction between a smaller diameter lower portion thereof and a larger diameter upper portion thereof, both portions being of substantially uniform diameter. The step is located either at a uniform distance from the club head end of the shaft, preferably at about 8-½ inches, or at a distance increased slightly and progressively from the shortest club to the longest club, and the step is positioned more than 27 inches from the lower end of a grip on the upper end of the shaft and at least 27 inches from the upper end of the grip, with detectable means being provided on or within the grip at a distance of 27 inches from the step, such as an outward or inward formation on the grip or a concentrated weight within the grip. Impulse forces are emanated from the step and transmitted through the upper shaft portion to the grip and the player's hands, such impulse forces being developed in response to impact of the club head with a ball and rebound therefrom and being readily detectable by the player to facilitate properly timed and synchronized action. A small weight may be provided at the step to augment the development of such impulse forces. Various configurations of the lower shaft portion may be used.

27 Claims, 20 Drawing Figures

10
11
12
13
14
15
16
17
18
19
20
21
22
23
24
25
26
27
27a
28
28a
28b
30
31
32
34
38
40
A
B
III
V

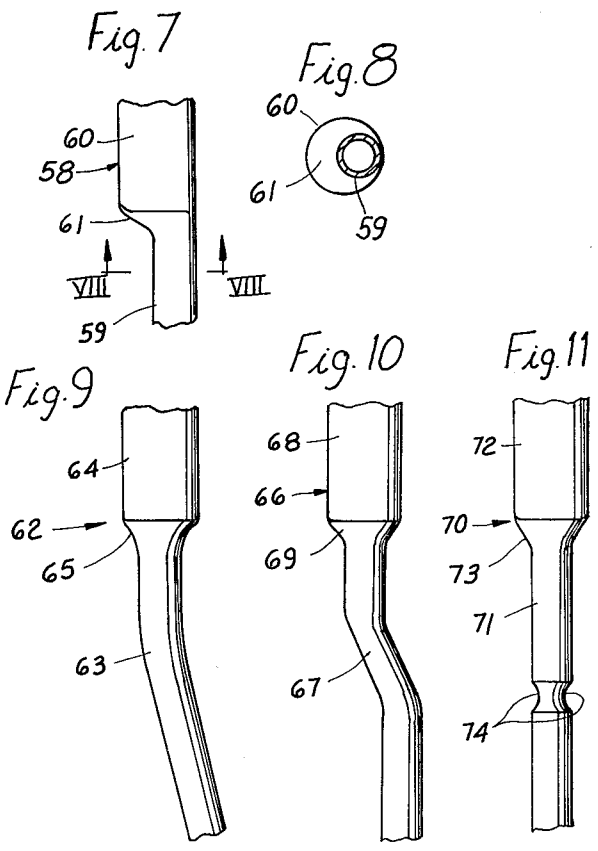
Fig. 7
60
58
61
VIII
VIII
59
Fig. 8
60
61
59
Fig. 9
64
62
65
63
Fig. 10
68
66
69
67
Fig. 11
72
70
73
71
74
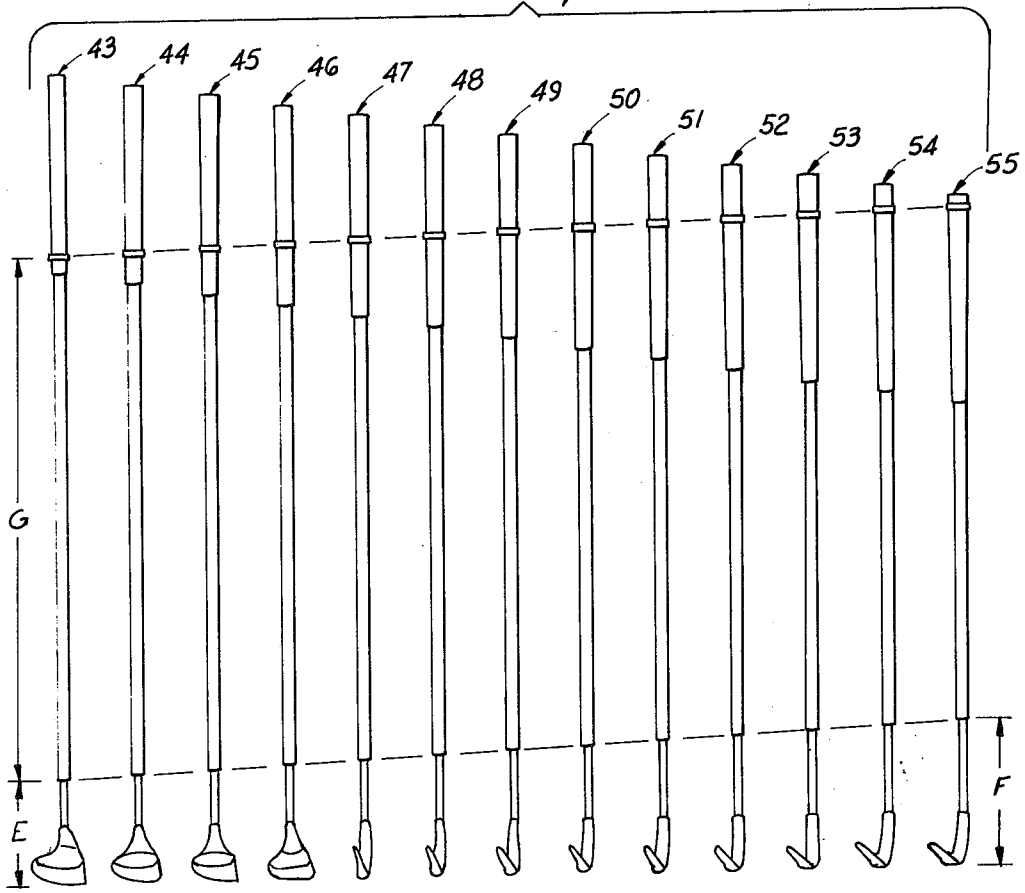
Fig. 6
42
43
44
45
46
47
48
49
50
51
52
53
54
55
G
E
F 76
78
79
80
81
82
83
84
85
86
89
90
91
92
93
96
98
101
102
103
104
105
108
109
110
111
112
113
114
118
119
120
121
122
123

GOLF CLUBS

This invention relates to golf clubs with which greatly improved results are obtained especially with regard to obtaining optimum shaft action and feel of the action of the shaft and club head by the player, providable in a matched set having uniform and predictable action, the golf clubs being readily and economically manufacturable.

BACKGROUND OF THE PRIOR ART

Prior art golf clubs have generally been made either with gradually tapered shafts or with shafts having a plurality of gradual steps along the length thereof. When golf clubs with such shafts are swung, the shaft bends during an initial portion of the players downswing to store energy therein. During a final portion of the downswing, such energy is released to accelerate the club head and, ideally, produce maximum velocity of the club head at impact. It is difficult to feel the action of the shaft and club head and obtaining the optimum action requires that the player develop a uniform swing action through long practice and that the character of the shaft in relation to the mass of the club head be properly matched to the characteristics of the player's swing action. Variations have been made in the materials used in shafts without changing the basic mode of operation thereof. Changes in the configuration of shafts have also been proposed. For example, in 1926, the Pollack British Pat. No. 256,049 proposed pressing the metal of a shaft inwardly at diametrically opposed paints to enable the shaft to yield, such being done at a plurality of points on the length of the shaft or in a manner such as to form one or more portions of the shaft into a shape of oblong cross-sectional form. In the 1936 Barnhart U.S. Pat. No. 2,050,554, a shaft was proposed having an upper portion tapered downwardly to a medial region at which the shaft wall was bulged outwardly to form a stiffening shoulder, with a lower portion of the shaft being tapered downwardly from the shoulder to the tip end secured to the club head. It is not known whether such shafts were ever actually used to any substantial degree and in any event, it is not believed that they ever enjoyed any substantial degree of acceptance. The action of such shaft in regard to "feel" and release of stored energy is difficult to analyze, especially as to complex configurations such as disclosed in the Pollack patent, but it is believed that the overall action of the shafts would be similar to that obtained with conventional shafts.

In my application for a design patent, Ser. No. 575,803, filed May 8, 1975, I disclose a shaft having a single step at the junction between an upper larger diameter portion and the lower smaller diameter portion, the length of the smaller diameter portion being on the order of one-quarter or less of the total shaft length. Since about late 1974 or early 1975, that shaft has been used commercially and publicly but only in putters, although I had previously experimented with use of similar shafts in woods and irons. In putters, strength and considerations with regard to obtaining maximum head velocity at impact are not important and the ornamental appearance of the shaft is of primary importance. Psychological factors are important in all aspects of golf, but are especially important in putting. So far as I know, shafts with any step similar to that provided in the aforesaid putters have not been used for wood or iron clubs other than in the course of my own experimental work and research.

SUMMARY OF THE INVENTION

This invention was evolved with the general object of providing improved golf clubs especially with regard to obtaining optimum shaft action and feel of the action of the shaft and club head by the player.

Another object of the invention is to provide a set of golf clubs having shafts which provide improved action and feel and which are matched to provide a uniform action, predictable to the player regardless of which club of the set is used.

A further object is to provide club shafts which provide uniform improved action and feel and which are economically manufacturable.

As indicated above, I have experimented for some time in using a shaft having a single step for woods and irons and have found that greatly improved results can be achieved. With the proper design, the action of the shaft and club head can be readily felt and the player can more easily and naturally obtain the proper timing of the action, uniformly more distance and greater accuracy.

The correct scientific explanation is not known with certainty but actual use shows that with a shaft having a single step at the junction between a smaller diameter lower portion and a larger diameter upper portion, forces are produced which are transmitted through the shaft and are of a form such that the player can much more accurately sense the club action. Apparently, transient forces developed at impact of the striking surface of the club head with the ball are transmitted through the small diameter lower portion to the step and as a result, impulse forces emanate from the step having a duration controlled by the effective value of the compliance of the smaller diameter portion and the mass of the club head. Such impulse forces then travel through the larger diameter portion to the grip and to the player's hands to provide a distinct feel of the impact with the ball. In addition, a second impulse is felt in response to rebound of the club head from the inpact with the ball.

In conventional clubs, impact forces are, of course, transmitted but are of much longer duration and of reduced peak amplitude, being controlled by the relationship between the effective compliance of the full length of the shaft and the mass of the club head and it is not possible to sense the timing of the impact. With a smaller diameter lower portion, however, the impulse developed is of short duration and high amplitude so as to be readily sensed. The action of the club head during a practice swing, without striking a ball, can also be detected, impulses being generally produced at the limits of movement of the club head and smaller diameter lower portion relative to the larger diameter upper portion. After taking a few practice swings, the player can properly synchronize the release action of the shaft with the approach of the club head to the ball, to obtain maximum club head velocity at impact.

Another advantage is obtained in that with a given club head loft angle and a given swing weight, the trajectory of the ball is lower especially with the lower irons and woods and longer distances can be obtained or alternatively, the club head can have a higher loft angle for a given distance. As a result, more of the club head face is visible to the player.

Important features relate to the positioning of the step. For a driver, the distance from the step to the upper end of a neck or hosel portion of the club head is preferably in the range of from 4 to 14 inches. For a No. 9 iron or wedge, such distance is preferably in a range of from 1 to 7 inches. In a set of matched clubs, a uniform distance from the step to the club head end may be used, but such distance may be changed to change progressively in generally uniform movements from a distance for a wedge or nine-iron to a different distance for the No. 1 wood or driver.

The position of the step in relation to the grip is important and it is found that it should be less than 27 inches from the lower end of the grip and at least 27 inches from the upper end of the grip, so that there will be some point on the grip which is 27 inches from the step and which can be contacted by some portion of the player's hand. It is believed that this 27 inch distance is important because of the emanation of impulse forces from the step and the fact that the normal distance from the fingers to the ground for practically all players, whether tall or short, is about 27 inches. That distance is normally and intuitively associated as the acting distance between actions at the hands and actions taking place at ground level through any stick or similar medium. Thus it is much easier to correlate the actions with the hands with the action of the club head at ground level and obtain greater control and accuracy.

In accordance with a specific feature, detectable means are provided on or within the grip at a distance of 27 inches from the step which can be felt by the hands of the player. For example, a strip of tape may be provided on the grip or, preferably, a solid member is provided having direct contact with the shaft and arranged to be contacted by the player's hands. In addition, or in the alternative, concentrated weight can be provided within the grip, sufficiently heavy to be felt by the player. As a result, the player can sense the distance from the step which corresponds to the location of the club head and obtain greater control and accuracy.

In accordance with a further specific feature, a small weight may be positioned within the shaft at the step in the form of a wood or metal plug having a weight of on the order of ¼ ounce, for example. This weight augments the development of impulse forces from the impact with the ball and the rebound of the club head.

Additional features relate to modifications in the construction of club heads, particularly with response to changes in the length of hosel or neck portions or members with certain relationships to the positioning of the step and to modifications in the construction of the step.

The smaller diameter lower portion may be in line and coaxial with the larger diameter upper portion but modifications may be used. Its axis may be parallel to and offset from the axis of the upper portion, it may be bent at an angle or provided with an offset portion or indentation. In any case, the basic action is the same.

The golf club construction of this invention has attributes and advantages in addition to those discussed above. With the longer clubs, the torque effect produced from impact with a ball is reduced while it is of larger magnitude with the shorter clubs. For manufacture of the shafts, tooling is required which differs from that used for conventional shafts but in quantity production, where tooling costs are amortized, the cost of production should be reduced substantially, considering the fact that both portions of the shaft are of substantially uniform diameter rather than being tapered and the fact that the step formation in all shafts for a set of clubs may be of identical form.

This invention contemplates other objects, features and advantages which will become fully apparent from the following detailed description taken in conjunction with the accompanying drawings.

BRIEF DESCRIPTION OF THE DRAWINGS

FIG. 6 is a view similar to FIG. 1, illustrating a modified set of golf clubs according to the invention;

FIG. 7 is a view illustrating a modified shaft construction;

FIG. 8 is a sectional view taken substantially along line VIII—VIII of FIG. 7;

FIG. 9 is a view illustrating another modified shaft construction;

FIG. 10 is a view illustrating still another modified shaft construction;

FIG. 11 is a view illustrating yet another modified shaft construction;

DESCRIPTION OF PREFERRED EMBODIMENTS

Figures 1, 2, 3, 4, 5:
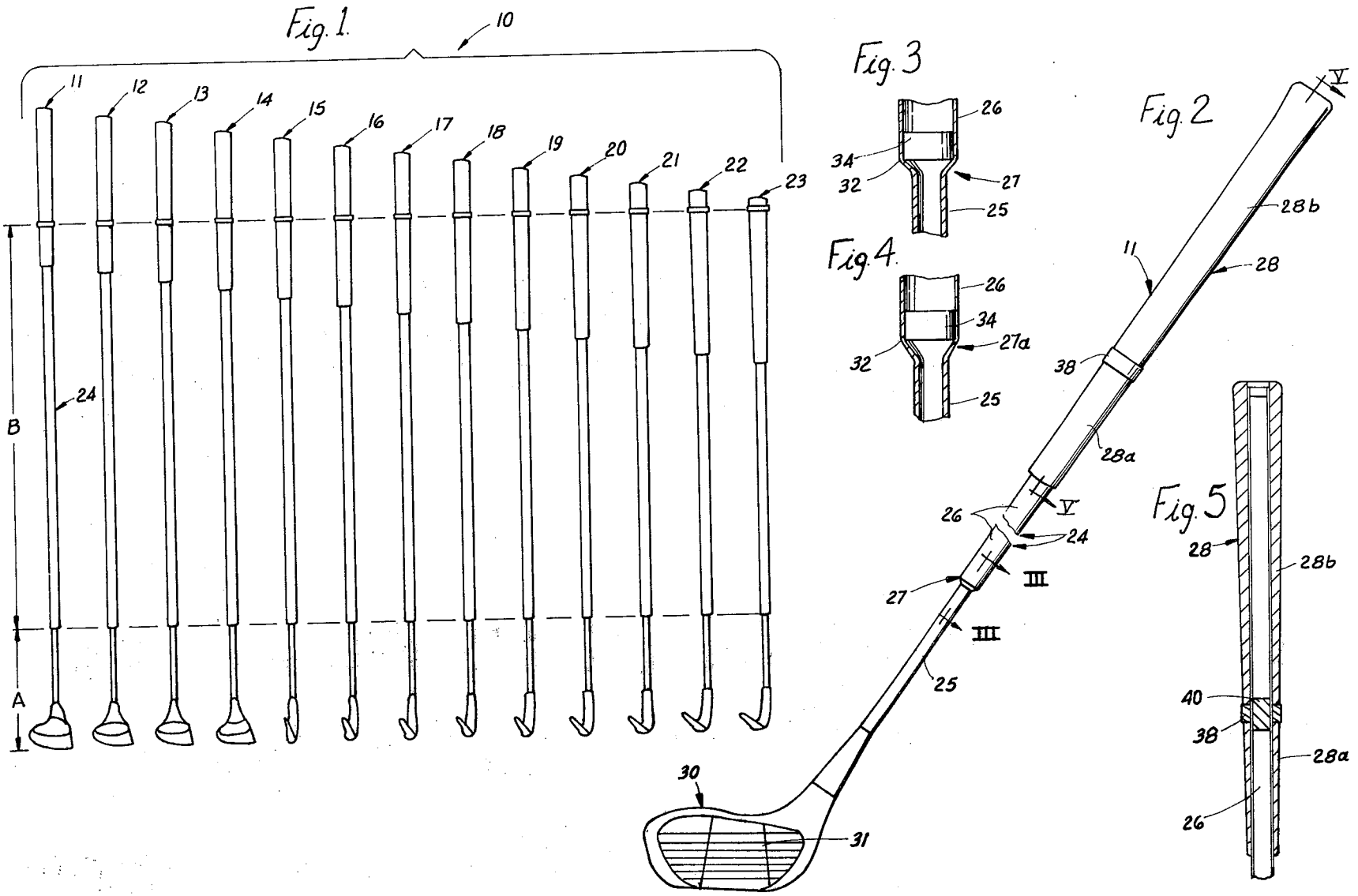
FIG. 1 shows a matched set of golf clubs constructed in accordance with the principles of this invention and the relationship between constructional features thereof.
FIG. 2 is a side elevational view of one of the clubs of the set of FIG. 1.
FIG. 3 is a cross-sectional view taken substantially along line III—III of FIG. 2.
FIG. 4 is a cross-sectional view similar to FIG. 3 but illustrating a modified arrangement.
FIG. 5 is a cross-sectional view taken substantially along line V—V of FIG. 2.

Reference numeral 10 generally designates a matched set of golf clubs constructed in accordance with the principles of the invention, including four woods such as a No. 1 wood or driver 11, a No. 2 wood or brassie 12, a No. 3 wood or spoon 13 and a No. 4 wood or cleek 14. The set further includes nine irons such as No. 2 through No. 9 irons 15–22 and a wedge 23.

FIG. 2 is a side elevational view of the driver or No. 1 wood 11 and shows a shaft and grip construction which is used for all clubs of the set, with certain dimensional variations as discussed hereinafter. The driver 11 includes a hollow shaft 24 having a lower smaller diameter portion 25 and an upper larger diameter portion 26 with a step 27 being formed at the junction between the upper end of the lower smaller diameter portion 25 and the lower end of the upper larger diameter portion 26. A grip 28 is secured on the upper end portion of the larger diameter portion 26 and the lower end of the smaller diameter portion 25 extends into and is secured to a head 30 having a striking surface 31 for contact with the ball.

The diameters of the portions 25 and 26 are preferably substantially uniform along the length thereof. The outside diameter of the upper portion 26 is preferably on the order of about 0.5 inches while the diameter of the portion 25 is preferably on the order of from 0.5 to 0.75 of that of the portion 26, i.e. from approximately 0.25 to 0.375 inches. Step 27 is located at a distance from the lower terminal end of the shaft which is in the range of from 5 to 10 inches, a distance of about 8.5 inches being preferred in a set such as illustrated in FIG. 1 in which the steps are all spaced the same distance from the lower terminal end, indicated by reference character A in FIG. 1.

The shaft operates in a manner similar to that of conventional shafts in that during an initial portion of the player's downswing, the shaft bends to store energy therein while during a final portion of the downswing, such energy is released, being applied to accelerate the club head for producing high velocity of the club head at impact. However, the "feel" of a club according to the invention is distinctly different from that of a club having a conventional type of shaft.

In particular, the player obtains a much more pronounced feel of the impact with the ball and also obtains a pronounced feel of a rebound of the club head after impact with the ball. Apparently, transient forces developed at impact of the striking surface 31 with the ball are transmitted through the small diameter lower portion 25 to the step 27 and the portion 25 together with the club head 30 operate to some extent as a resonant combination having a mass determined primarily by the mass of the club head and having a compliance determined to a very substantial extent by the length of the small diameter portion 25. As a result, a short duration impulse force is developed at the step 27 and emanates therefrom to travel through the portion 26 and thence through the grip 28 to the player's hands. Such impulse forces have a short duration and high intensity which are readily felt. After impact, the club head 30 rebounds from the ball and at the limit of its travel in the rebound direction, impulses forces are again generated in a similar manner to emanate from the step 27 and travel through the portion 26 to the grip 28 and thence to the player's hands. Clubs having shafts of conventional construction cannot produce this type of action because the mass of the club head acts in conjunction with a compliance determined by the total length of the shaft. The forces applied through the grip to the player's hands are then of long duration and greatly reduced peak amplitude, providing little or no feel as to the timing of impact and rebound.

In any case, whatever may be an accurate scientific explanation, the effect of the construction of the invention is to provide a greatly improved feel of the action of the club head and with a little practice, the player can readily control his swing to obtain optimum timing of the release of the energy stored in the shaft and maximum control and accuracy as well as increased distance.

The construction also has an effect on torque transmitted through the shaft following impact which is less in the longer clubs and more in the shorter clubs.

FIG. 3 shows a preferred form of the step 27 in which a flared wall portion extends from the upper end of the lower shaft portion 25 to a rounded connection 32 to the lower end of the upper shaft portion 26 and has a gradually decreasing wall thickness, the lower shaft portion 25 having a larger wall thickness (0.020–0.030 inches, for example) than that of the upper shaft portion 26 (0.010–0.015 inches, for example). The mean angle of the flare in FIG. 3 is approximately 45° relative to the shaft axis which allows a substantial amount of flexing at the step and which is desirable for optimum feel, as hereinafter discussed. FIG. 4 illustrates a modified step **27*a*** in which the mean angle of the flare is smaller, approximately 25° and in which the axial length is greater, increasing rigidity at the step but allowing development of impulses thereat.

A small plug 34 is provided adjacent the step 27 in FIG. 3 or step **27*a* in FIG. 4, preferably in the end of the upper shaft portion 26. Plug 34 may be of wood, plastic, metal or other solid material and preferably by a weight of on the order of 0.25 ounces. Plug 34** is not essential but it is desirable for enhancing the feel of the action of the club head, especially with regard to the feel of rebound.

As previously indicated, the position of the step in relation to the grip is important and there should be a portion of the grip engagable by the player's hands and positioned at a distance approximately 27 inches from the strap. Thus the distance from the step to the lower end of the grip should be less than 27 inches and the distance from the step to the upper end of the grip should be at least 27 inches. Preferably, and in accordance with a specific feature of the invention, detectable means are provided on or within the grip at a distance of 27 inches from the step, of such form that it can be felt by the hands of the player. Such detectable means may take the form of a ring 38 secured on the outside of the upper shaft portion 26 with the grip 28 being formed in two parts **28*a* and 28*b* below and above the ring 38. Alternatively, the grip 28 may be continuous and the ring 38 may be thinner on the outside thereof with one or more portions projecting inwardly through the grip to contact the shaft. In addition, or as an alternative, a concentrated weight 40 may be disposed within the upper part of the shaft which carries the grip 28. Plug 40** is located at a distance of 27 inches from the step.

As indicated in FIG. 1, the detectable means of all of the clubs of the matched set 10 are located at the same distance from the step of the shaft, as indicated by reference character B.

The distance from the step to the lower terminal end of the shaft is not critical but it should be at least 1 inch and less than 16 inches. In the matched set 10 illustrated in FIG. 1, a uniform spacing distance is used, as indicated by reference character A, preferably about 8½ inches.

Referring to FIG. 6, reference numeral 42 generally designates a modified form of a matched set of clubs, again including 13 clubs 43–55, respectively corresponding to clubs 11–23 and of similar construction, except that instead of using a uniform spacing from the step to the lower terminal end of the shaft, the distance is varied. In the illustrative arrangement, the spacing distance progressively changes from a shorter distance indicated by reference character E for the longest club of the set to a longer distance, indicated by reference character F, for the shortest club of the set. The shortest distance, indicated by reference character E may be approximately 5 inches while the longest distance, indicated by reference character F, may be 8½ inches. In this set, as in the set of FIG. 1, the distance between the step and the detectable means, indicated by reference character G, is uniform and preferably 27 inches in all cases.

FIGS. 7 and 8 illustrate the step region of a modified form of shaft 58 which includes a lower smaller diameter portion 59 and an upper larger diameter portion 60 with a step 61 therebetween. As shown, the axis of the lower portion 59 is offset from and parallel to the axis of the upper portion 60.

FIG. 9 illustrates the step region of another modified form of shaft 62, including a lower smaller diameter portion 63 and an upper larger diameter portion 64 with a step 65 at the junction therebetween. As shown, the lower portion 63 is bent so that the lower part thereof extends angularly away from the axis of the upper part of the lower portion 63 which is coincident with the axis of the upper portion 64.

FIG. 10 illustrates the step region of still another modified form of shaft 66 which includes a lower portion 67, an upper portion 68 and a step 69. In this construction, the lower portion 67 has an upper part on an axis coincident with that of the upper portion 68, an intermediate angularly extending part and a lower part on an axis parallel to and offset from the axis of the upper portion 68.

FIG. 11 illustrates the step region of still another modified form of shaft 70 which includes a lower smaller diameter portion 71, an upper larger diameter portion 72 and a step 73. In this construction, diametrically opposed parts of the lower portion 71 are depressed inwardly, as indicated by reference numeral 74. Modified constructions such as shown in FIG. 7–11 may be used for obtaining different lies of the club head relative to the shaft and for varying characteristics to a certain extent. However, the basic mode of operation is the same as with the construction illustrated in FIGS. 2–5.

Figures 12, 13, 14, 15, 16:
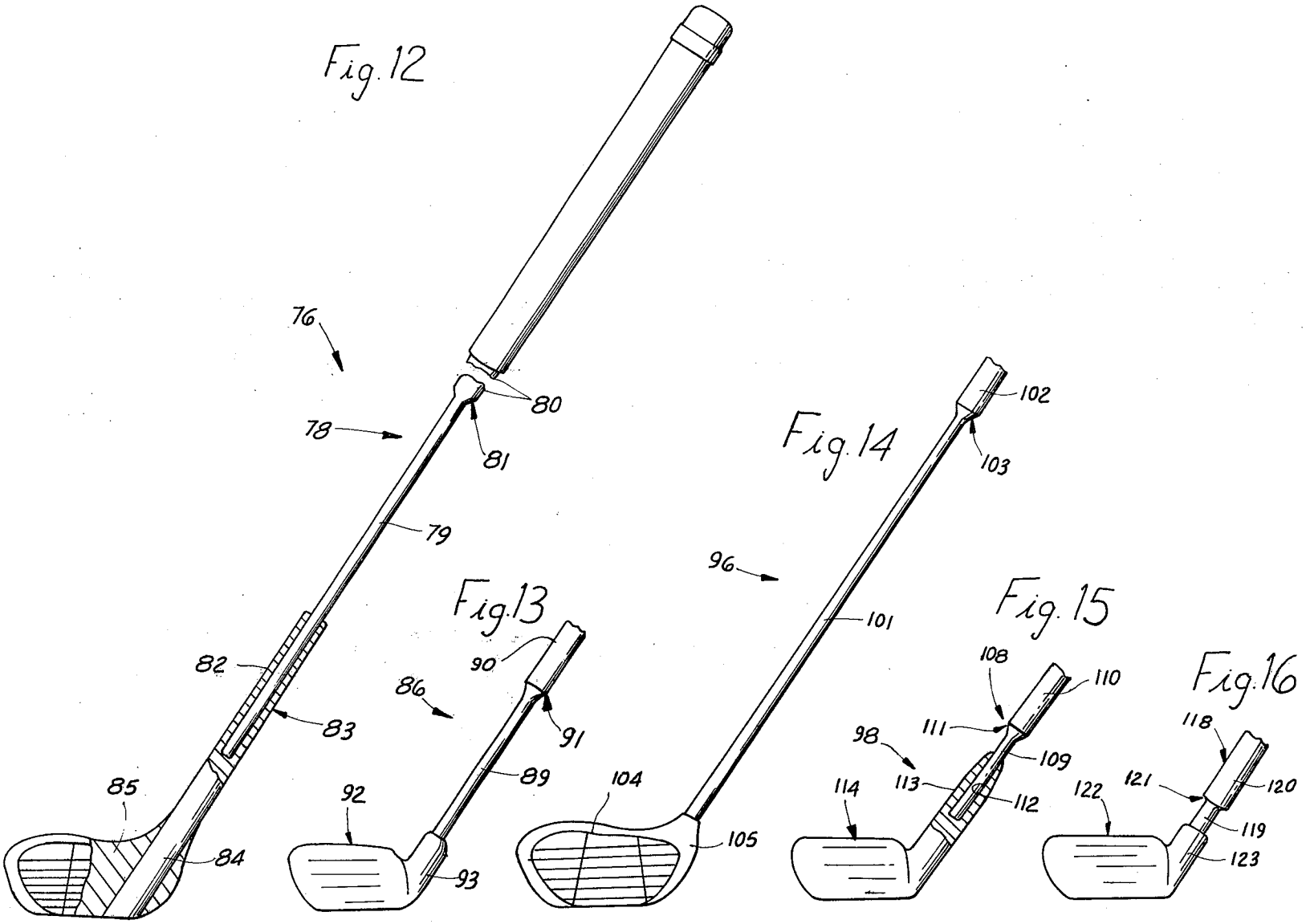
FIG. 12 shows a modified form of driver.
FIG. 13 shows a modified form of wedge.
FIG. 14 shows another modified form of driver.
FIG. 15 shows another modified form of wedge.
FIG. 16 shows still another modified form of wedge.

FIG. 12 shows a modified form of No. 1 wood or driver 76 including a shaft 78 having a lower end portion 79, an upper end portion 80 and a step 81. The lower end part of the lower shaft portion 79 is secured in a hollow upper end portion 82 of a hosel member 83 which has a solid lower end portion 84 secured in an opening of a club head 85. The hosel member 83, which may be of aluminum for example is relatively rigid and the flexing action of the lower shaft portion 79 takes place between the upper end of the hosel member 83 and the step 81.

FIG. 13 illustrates a modified form of wedge 86 including a shaft 88 having a lower end portion 89, an upper end portion 90 and a step 91. The lower end part of the lower shaft portion 89 is secured in an opening in a head 92 which may have a short upwardly projecting neck or hosel portion 93.

The driver 76 of FIG. 12 and the wedge 86 of FIG. 13 may preferably be clubs of a matched set in which there is a fixed distance, 8 inches for example, from the step of the shaft to the upper end of the hosel. Thus the distance from the step 81 to the upper end of the member 83 in the driver 76, the corresponding distance in other wood clubs of the set, the distance from the step 91 to the upper end of the neck or hosel portion 93 in the wedge and the corresponding distance in other iron clubs of the set are all substantially the same. In the No. 2 iron, the head may have a hosel or neck portion extended upwardly a substantial distance, approaching that of the No. 4 wood of the set and the projection of the neck or hosel portions of the heads of the No. 3 through No. 8 irons have progressively decreasing values.

The grips of the clubs 86 of FIG. 14 is not illustrated but it will be understood that the distance from the step to detectable means on the grips of all clubs of the set is preferably 27 inches in each case and the length of the hosel member 83 for the driver is preferably about 8 inches. With overall club lengths ranging from 43 inches for the driver down to about 35 or 36 inches for the wedge, the detectable means are all located at or close to the upper ends of the grips.

FIGS. 14 and 15 illustrate portions of a modified driver 96 and modified wedge 98 of another set of matched clubs in which the operative length of lower shaft portions are progressively changed from a long length for the driver down to a very short length for the wedge. The driver 96 includes a shaft 100 having a lower portion 101, an upper portion 102 and a step 103. The lower end part of the lower shaft portion 101 is secured in an opening in a head 104 which may have a short neck or hosel portion 105. The wedge 98 includes a shaft 108 having a lower portion 109, an upper portion 110 and a step 111. The lower part of the lower shaft portion 109 is secured in an opening 112 in a neck or hosel portion 113 of a head 114. The neck or hosel portion 113 is relatively long and there is only a short distance, approximately 1 inch for example between the upper end of the neck or hosel portion 113 and the step 111.

FIG. 16 shows a lower portion of another modified form of wedge 116 which may be part of a matched set with the driver 76 of FIG. 12 or the driver 96 of FIG. 14. Wedge 116 includes a shaft 118 having a lower portion 119, an upper portion 120 and a step 121. The lower part of the lower shaft portion 119 is secured in an opening of a head 122 which may be similar to the head 92 of FIG. 13, having a short neck or hosel portion 123. Unlike the wedge of FIG. 13, however, the distance from the upper end of the neck or hosel portion 123 to the step 121 is quite short, 1 inch for example.

When the wedge of FIG. 16 is used as part of a matched set with the driver 76 of FIG. 12, the effective lengths of the hosel members or head portions are progressively decreased in value, for the clubs between the driver and the wedge. When the wedge 116 of FIG. 16 is part of a matched set with the driver 96 of FIG. 14, all clubs of the set have short or non-existent neck or hosel portions and the distance from the head to the step of the shaft is progressively decreased in value for the clubs between the driver and the wedge. In each case, the detectable means on the grip of the club is located at a distance of about 27 inches from the step of the shaft thereof and when the wedge 116 of FIG. 16 is used as part of a matched set with the driver 96 of FIG. 14, in which the distance from the upper end of the neck or hosel portion of the club head to the step in the driver is approximately 14 inches, the detectable means are positioned farther and farther away from the upper end of the grip as you go from the driver down to the wedge.

It is noted that with respect to the various matched sets as illustrated and described, there are three distances which may be uniform throughout the set or progressively changed in going from the driver down to the wedge, the first distance being the distance between the sole of the club head and the upper end of the neck or hosel portion or member of the club head, the second distance being the distance from the upper end of the neck or hosel member or portion of the club head to the step of the shaft, i.e. the operative portion of the lower shaft portion and the third being the distance from the upper end of the grip to the detectable means of the grip. In the set of FIG. 1, the first and second distances are uniform, while the third distance decreases. In the set 42 of FIG. 6, the first distance is uniform, the second distance increases and the third distance decreases. In the set including the driver of FIG.. 12 and the wedge of FIG. 13, the first distance decreases and the second and third distances are uniform. In the set including the driver of FIG. 14 and the wedge of FIG. 15, the first distance is uniform, the second decreases and the third is uniform. In the set including the driver of FIG. 12 and the wedge of FIG. 16, the first and second distances decrease while the third increases. In the set including the driver of FIG. 14 and the wedge of FIG. 16, the first distance is uniform, the second distance decreases and the third increases.

Each of such sets as illustrated and described has advantages either from the standpoint of ease and economy of manufacture or from the standpoint of satisfying the swing requirements and preferences of an individual player. For example, the arrangements of FIG. 1 and 6 have the advantage that club heads of conventional construction may be used while sets such as one using the driver of FIG. 12 and the wedge of FIG. 13 or one using the driver of FIG. 14 and the wedge of FIG. 15 can more closely satisfy the requirements of particular players, especially the better players. In all sets, the use of the shaft of the invention, having a single step positioned within the described limits provides greatly improved shaft action and feel of the action of the shaft and club head by the player, and the provision of detectable means in or on the grip, positioned as described and illustrated, augments such improved results.

Figure 17:
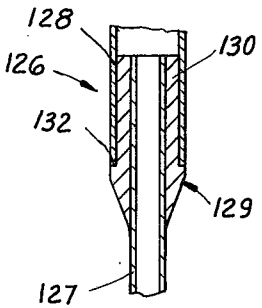
FIG. 17 shows a modified step construction.

FIG. 17 illustrates the step portion of a modified shaft 126 in which a lower smaller diameter portion 127 and an upper larger diameter portion 128 are separate members which are secured together by means of a tubular member 129. The member 129 has an upper end portion 130 fitted in the lower end of the upper shaft portion 128 and a lower portion 131 extending downwardly from the lower end of the upper shaft portion 128, the outer surface of the lower portion 131 being preferably of frusto-conical shape. An upwardly facing annular shoulder 132 may be provided at the junction between junctions 130 and 131, abutting the lower end of the upper shaft portion 128. The shaft portions may be secured to the tubular member 129 and in a suitable way as by means of epoxy or other strong adhesives and in the alternative, or in addition, a pin 133 may extend in a diametral direction through the walls of the upper shaft portion 128 and upper portion 130 of member 129 and also through the wall of the lower shaft portion 127, the upper end of which may be positioned above the lower end of the upper portion 128, preferably in alignment with the upper end of member 129 as illustrated. In FIG. 17, the illustrated shaft portions 127 and 128 are concentric but, if desired, the member 129 may be so formed that an angular relationship is provided therebetween. This arrangement has an advantage in that the shaft portions do not have to be formed to be integral with each other and each can be a straight tubing member of a type readily and economically manufacturable. It also has an advantage in that an additional weight is provided at the step portion of the shaft. However, it has a disadvantage in that an assembly operation is required and also, obtaining optimum flexing action at the step may be a problem.

Figure 18:
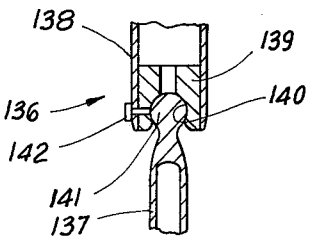
FIG. 18 shows another modified step construction.

FIG. 18 illustrates a step portion of another modified form of shaft 136 in which lower and upper shaft portions 137 and 138 are formed as separate members. A bushing 139 is secured within the lower end part of the upper shaft portion 138 and has a frusto-spherical internal surface 140 receiving a spherical ball 141 which is secured to or formed as an integral part of the upper end of the lower shaft portion 137. A set screw 142 is provided having a shank portion threaded through the wall of the upper shaft portion 138 and the bushing 141 to engage the ball 141 and to fix the relative angular orientation of the shaft portions 137 and 138. It will be appreciated that with this arrangement, the relative orientation of the shaft portions can be adjusted as desired. The lower shaft portion 137 may be either straight, as illustrated, or may include an offset such as an offset of the type illustrated in FIG. 10.

Figure 19:
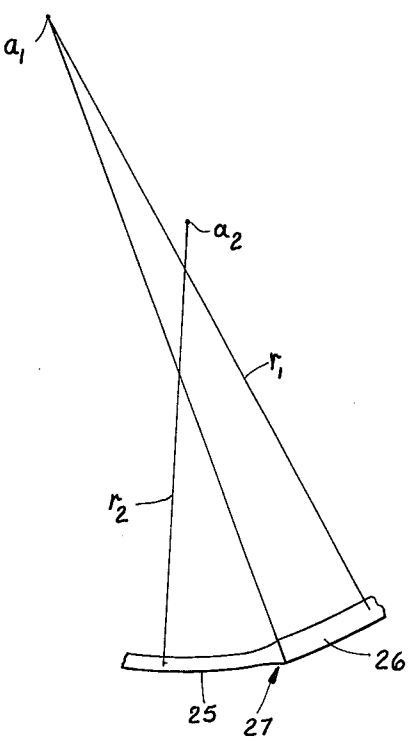
FIG. 19 diagrammatically illustrates the bending action of a shaft.

FIG. 19 diagrammatically illustrates the manner in which the shaft 24 of the driver 11 bends during the down swing of the club, for example. The upper shaft portion 26 bends generally about an axis $a_1$ in a plane through the lower end of the upper portion 26, with a relatively long bend radius indicated by $r_1$. The lower shaft portion 25 bends about an axis $a_2$ with a shorter radius $r_2$. Axis $r_2$ is offset from the plane through axis $a_1$ and the lower end of the upper portion 26 in an upward direction, i.e. toward the grip, due to a bending or flexing action which takes place at the step 27. As above indicated, a substantial amount of flexing takes place at the step with an angle of flare as shown in FIG. 3.

Figure 20:
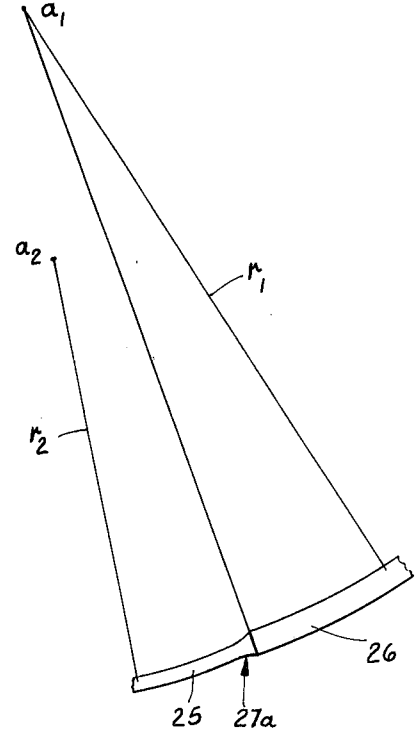
FIG. 20 is similar to FIG. 19, showing the bending of a different shaft.

FIG. 20 illustrates the manner in which the shaft bends when the step portion is more rigid as when the angle of the flare is increased. In this case, the axis $a_2$ of the bend of the lower portion 25 may be offset in a downward direction from the plane through axis $a_1$ and the lower end of the upper shaft portion.

It is noted that FIGS. 19 and 20 are intended to illustrate the type of bending actions which take place and are exaggerated to some degree for this purpose. Normally, the shaft is not stressed to the extent suggested by these figures. It is noted, however, that there are under any given conditions three bending actions. The first is that of the upper shaft portion, which the radius of the bend being determined by the applied stress, the diameter and wall thickness and the characteristics of the material. The second bending action is that of the lower shaft portion with the radius of the bend being determined in a similar fashion by the applied stress, the diameter and wall thickness and the characteristics of the material. The radius of bend of the lower shaft portion with a given applied stress is substantially less than the radius of bend of the upper shaft portion, because of its smaller diameter, even though the wall thickness may be on the order of twice that of the upper shaft portion. The third bending action is that of the step portion, determined to a large extent by the angle of the flare, the bending action being increased as a function of an increase in the angle of the flare. With a reduced angle of flare as shown in FIG. 4, the bending action is reduced and with a construction such as shown in FIG. 17, there is very little bending action in the step region which is quite rigid, so that the only significant bending actions are those of the upper and lower shaft portion. In general, a substantial bending action such as obtained with a relatively large angle of flare as illustrated in FIG. 3 is preferred, providing a high degree of sensitivity with respect to feeling the action of the shaft and the club head by a player. However, significant improvements are still obtained using more rigid step portions and it is noted that when the step portions are more rigid, the diameter of the lower shaft portion may be decreased to decrease the radius of bend thereof and to offset the increased rigidity of the step portion.

It will be understood that modifications and variations may be effected without departing from the spirit and scope of the novel concepts of this invention.

I claim as my invention:

1. A golf club, comprising: a hollow shaft having a lower smaller diameter portion and an upper larger diameter portion with a step at a junction between the upper end of said smaller diameter portion and the lower end of said larger diameter portion, said larger diameter portion having a diameter of on the order of 0.5 inches and said smaller diameter portion having a diameter on the order of from 0.5 to 0.75 of that of said larger diameter portion, a grip secured on an upper end portion of said larger diameter portion of said shaft, and a head secured to a lower end portion of said smaller diameter portion and having a striking surface for impact with a golf ball to propel the ball a distance of at least on the order of 100 yards, said lower smaller diameter portion and said upper larger diameter portion being substantially uniform along their respective lengths, said step being located a substantial distance above said head to provide an exposed length of said smaller diameter portion between said head and said step, and said step being also located a substantial distance below the lower end of said grip to provide an exposed length of said upper diameter portion between said step and the lower end of said grip, transient forces developed during impact of said head with the ball and rebound following impact being rapidly transmitted through said exposed length of said smaller diameter portion to said step to develop at said step impact and rebound forces of short duration successively transmitted through said exposed length of said larger diameter portion and through said grip to the player's hands.

2. In a golf club as defined in claim 1, the distance between said step and the lower end of said grip being less than 27 inches and the distance from said step to the upper end of said grip being at least 27 inches.

3. In a golf club as defined in claim 2, detectable means located at a localized region of said grip approximately 27 inches from said step and arranged to be felt through the player's hands during swinging of the club.

4. In a golf club as defined in claim 3, said detectable means including means on the outer surface of said grip contacted by a portion of the player's hands.

5. In a golf club as defined in claim 3, said detectable means including a weight within said grip.

6. In combination a golf club as defined in claim 1, a plurality of additional clubs each having a shaft, a grip and a head as defined and forming therewith a matched set of clubs having shafts of different lengths and heads arranged to propel a ball different distances.

7. In a set of clubs as defined in claim 6, the steps of the shafts of all clubs being located at distances from the lower end of the smaller diameter portion of the shafts thereof lying within a narrow distance range, and detectable means located at a localized region of the grip of each club approximately 27 inches from the step of the shaft thereof and arranged to be felt through the player's hands during swinging of the club, said detectable means being closer to the upper end of the grip of the shortest club of said set and closest to the lower end of the grip of the longest club of said set.

8. In a set of clubs as defined in claim 6, the steps of the shafts of all clubs being located at substantially the same distance from the lower end of the smaller diameter portion of the shaft thereof.

9. In a set of clubs as defined in claim 6, the steps of the shafts of all clubs being located at distances from the lower end of the smaller diameter portion of the shaft thereof lying within a narrow distance range but decreasing progressively from a longer distance in the shortest club to a shorter distance in the longest club.

10. In a golf club as defined in claim 1, weight means located within said hollow shaft at said step.

11. In a golf club as defined in claim 10, said weight means having a weight of on the order of 0.5 ounces.

12. In a set of clubs as defined in claim 6, the steps of the shafts of all clubs being located at distances from the lower end of the smaller diameter portion of the shaft thereof lying within a narrow distance range but decreasing progressively from a longer distance in the longest club to a shorter distance in the shortest club.

13. In a set of clubs as defined in claim 6, all clubs of said set having shafts with substantially identical steps and with substantially identical diameters and wall thicknesses of upper and lower shaft portions thereof, the length of at least one of said upper and lower shaft portions being changed in uniform steps from the longest distance club to the shortest distance club thereof.

14. In a golf club as defined in claim 1, wherein at an instant of time during a downswing of said club a stress is applied to said shaft to cause said upper and lower shaft portions to extend in arcs having radii determined by the applied stress, diameter, wall thickness and character of the material thereof, the radii of the arc of said upper shaft portion being substantially greater than the radius of the arc of said lower shaft portion.

15. In a golf club as defined in claim 14, wherein said step has a certain stiffness determined in part by the angle of flare thereof and determinative of the position of the center of the arc of said lower shaft portion relative to the center of the arc of said upper shaft portion, said stiffness being such that the center of the arc of said lower shaft portion is located upwardly relative to a plane through the lower end of said upper shaft portion with the angle of flare of said step being on the order of 45°.

16. In a golf club as defined in claim 14, wherein said step has a certain stiffness determined in part by the angle of flare thereof and determinative of the position of the center of the arc of said lower shaft portion relative to the center of the arc of said upper shaft portion, said stiffness being such that the center of the arc of said lower shaft portion is located below a plane through the lower end of said upper shaft portion with the angle of flare of said step being substantially less than 45°.

17. In a golf club as defined in claim 16, the angle of flare of said step being on the order of 25° or less.

18. In a golf club as defined in claim 1, said upper and lower shaft portions being on a common axis.

19. In a golf club as defined in claim 1, said upper and lower shaft portions having axes in parallel offset relation.

20. In a golf club as defined in claim 1, said lower shaft portion including an angularly extending part having an axis at a substantial angle in relation to the axis of said upper shaft portion.

21. In a golf club as defined in claim 20, said lower shaft portion including a lower portion below said angular part and having an axis in generally parallel offset relation to the axis of said upper shaft portion.

22. In a set of golf clubs as defined in claim 6, wherein the head of each club includes a sole and a hosel portion and wherein the distance from the sole of each club head to the upper end of the hosel portion thereof is substantially the same for all clubs of the set.

23. In a set of golf clubs as defined in claim 6, wherein the head of each clubs includes a sole and a hosel portion and wherein the distance from the sole of each club head to the upper end of the hosel portion thereof is changed uniformly from one distance where the longest club of the set to a different for the shortest distance club of the set.

24. In a set of golf clubs as defined in claim 23, said distance being increased progressively from the longest distance club of the set to the shortest distance club of the set.

25. In a set of golf clubs as defined in claim 23, said distance being decreased progressively from the longest club of the set of the shortest distance club of the set.

26. In a golf club as defined in claim 10, said weight means comprising a sleeve portion within the lower end of said upper shaft portion and surrounding the upper end of said lower shaft portion, said sleeve portion thereby defining said step.

27. In a golf club as defined in claim 26, means defining an adjustable ball-and-socket connection between the upper end of said lower shaft portion and said sleeve portion.

* * * * *